United States Patent [19]

Pidcock et al.

[11] 4,315,405

[45] Feb. 16, 1982

[54] COMBUSTION APPARATUS

[75] Inventors: Anthony Pidcock; Desmond Close; William C. T. Kwan, all of Derby, England

[73] Assignee: Rolls-Royce Limited, London, England

[21] Appl. No.: 98,173

[22] Filed: Nov. 28, 1979

[30] Foreign Application Priority Data

Dec. 9, 1978 [GB] United Kingdom ..... 47868/78

[51] Int. Cl.[3] ..... F23R 3/46

[52] U.S. Cl. ..... 60/752; 60/751

[58] Field of Search ..... 60/759, 758, 752, 751, 60/740, 748, 725, 39.36, 39.37

[56] References Cited

U.S. PATENT DOCUMENTS

| | | | |
|---|---|---|---|
| 2,882,681 | 4/1959 | Hudson et al. | 60/740 |
| 2,916,878 | 12/1959 | Wirt | 60/759 |
| 3,726,087 | 4/1973 | Bryce | 60/759 |

*Primary Examiner*—Robert E. Garrett

*Attorney, Agent, or Firm*—Cushman, Darby & Cushman

[57] ABSTRACT

The airflow into a gas turbine engine combustion chamber e.g. through the primary air inlet and the dilution air inlets is directionally controlled by airflow directing inserts located in the air inlets. The inserts preferably comprise an open-ended cellular honeycomb structure.

4 Claims, 1 Drawing Figure

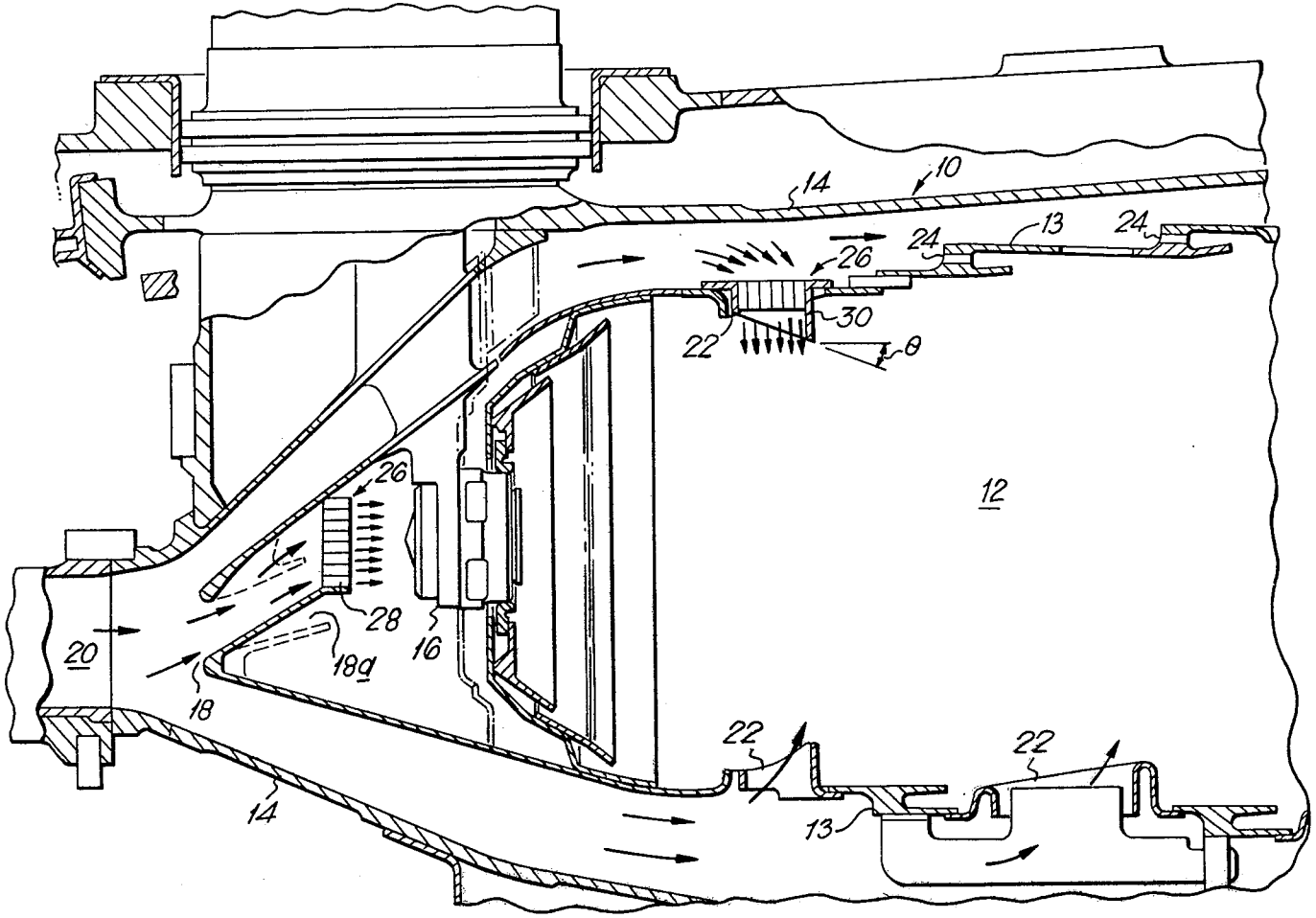
10
12
13
14
16
18
18a
20
22
24
26
28
30
θ

COMBUSTION APPARATUS

This invention relates to combustion apparatus for gas turbine engines and is particularly concerned with controlling the direction of airflows into the combustion apparatus, e.g. the primary air inlet flow and the dilution air flow.

It is important that the primary air flow enters the fuel injector of the combustion apparatus parallel or as nearly so as possible to the primary air flow duct of the fuel injector so as to avoid turbulence and uneven flow patterns. Equally it is important that the dilution air enters the combustion chamber of the combustion apparatus at the correct angle to ensure adequate mixing with, and penetration of, the fuel and air mixture in the combustion chamber.

Accordingly the present invention provides a gas turbine engine combustion apparatus having a plurality of air inlets, at least one of said inlets having airflow directing means the or each airflow directing means comprising a plurality of ducts having respective airflow inlets and outlets and arranged to direct in a predetermined direction an airflow external of the combustion apparatus to a location in the combustion apparatus.

The airflow directing means may be located in each air inlet to the combustion apparatus, e.g. the primary air inlet or inlets and the dilution air inlets.

The airflow directing means may comprise an insert having a number of adjacent ducts of suitable cross-sectional shape e.g. circular, hexagonal etc and in one arrangement, the airflow directing means comprises a section of open-ended honeycomb material held in a circular section chute which is mounted in the dilution air inlets of a gas turbine engine combustion chamber. The honeycomb material comprises a number of hexagonal section open-ended ducts whose length to distance between opposite sides ratio lies in the range 2 to 3.

The present invention will now be more particularly described with reference to the accompanying drawing which shows one form of gas turbine engine combustion apparatus according to the present invention.

In the drawing, a combustion apparatus 10 for a gas turbine engine (not shown) comprises an annular combustion chamber 12 defined by an inner casing 13 and mounted within an outer casing 14 and having a number of fuel injectors 16 (only one being shown) and a primary air inlet 18 which receives compressed air from the engine compressor via a number of guide vanes 20.

Engine compressor air enters the combustion apparatus through a number of inlets namely, the primary air inlet 18, dilution air inlets 22 and though they do not concern us here, cooling air inlets 24.

The primary air inlet 18 is offset from the centre-line of the fuel injector 16 and combustion chamber 12 towards the engine centre-line and the primary air is normally directed along passage 18*a* shown in chain line. This arrangement tends to result in an uneven air flow distribution at the fuel injector and consequent maldistributions downstream of the fuel injector.

In the present case, the passage 18*a* has been re-aligned, as shown in solid line and an airflow directing device 26, in the form of an insert located at the outlet of the re-aligned passage.

The airflow directing device 26 comprises an insert of honeycomb material having open-ended hexagonal section ducts 28, the longitudinal axes of which are parallel to the centre-line of the fuel injector 16. Thus the air flowing in the primary air intake flows along the re-aligned passage 18*a* and through the ducts 28 in the insert so that the airflow emerging from the device 26 is axially aligned with the fuel injector 16.

Similarly, the dilution air inlets 22 are each provided with an airflow directing device 26 in the form of an insert although only one dilution air inlet is shown fitted with a device 26 for the purpose of comparison.

The device 26 is located in a chute 30 which is secured in the dilution air inlet, the chute being of circular section.

The use of the device 26 in a dilution air inlet provides a more perpendicular flow of dilution air into the combustion chamber as compared to a dilution air inlet without a device 26 (see the dilution air inlets 22 in the lower half of the illustration) and can increase the dilution air mass flow because the inlets 22 are fed by the static pressure drop from the annulus between the combustion chamber and the casing 14 and the small passage 28 in the honeycomb material give a static pressure recovery. This does not apply to the device 26 placed upstream of the fuel injector since this device is fed by total pressure and there will be a reduction in mass flow.

A particular advantage accured from application of the device 26 in a dilution chute 30 is a reduction in the depth of chute necessary to provide directional control of the dilution air, and a consequent reduction in the risk of thermal damage to the chute. The chute 30, with the insert 26 fitted to control the flow direction, could therefore be cut back to give reduced penetration of the chute into the hot combustion zone.

The passage length to width ratio is optimised for each particular condition of cross flow and pressure loss and the chute length can be adjusted as required.

Although the insert has been described as being of honeycomb material, it can also comprise a concentric cylinders or square cells.

We claim:

1. A combustion apparatus for a gas turbine engine comprising:

an outer casing;

a combustion chamber within said outer casing and defined by an inner casing spaced from said outer casing;

said combustion chamber having at least one primary air inlet and a plurality of dilution air inlets; and at least one of said dilution air inlets having an airflow directing means arranged to receive an airflow from a source of compressed air and to direct said airflow in a predetermined direction to a location within the combustion chamber, said airflow directing means comprising an array of parallel arranged adjacent ducts having axes normal to an axis of the combustion chamber, each of said ducts having an inlet and an outlet, the direction of airflow to be directed being oblique to a common plane containing the inlets to said ducts of said airflow directing means, said outlets for said ducts lying in a common plane closely adjacent to the casing of said combustion chamber, and each of said ducts having a length to width ratio in a range of 2 to 3.

2. A combustion apparatus as claimed in claim 1, in which airflow into said at least one primary air inlet is angularly misaligned with the axis of said combustion chamber, an airflow directing means located in said at least one primary air inlet for discharging airflow in a direction parallel to the axis of the combustion chamber, and said airflow directing means located in said primary air inlet comprising an array of parallel arranged adjacent ducts having axes parallel to the axis of the combustion chamber and having inlets lying in a first common plane and outlets lying in a second common plane parallel to said first common plane, each of said ducts of said airflow directing means located in said primary air inlet having a length to width ratio in a range of 2 to 3.

3. Combustion apparatus as claimed in claims 1 or 2 in which said airflow directing means in said primary air inlet and/or said dilution air inlets comprises an open ended cellular structure.

4. Combustion apparatus as claimed in claim 3 in which the open-ended cellular structure comprises a honeycomb structure having hexagonal section open-ended ducts.

* * * * *